United States Patent [19]

Masas

[11] Patent Number: 4,684,050

[45] Date of Patent: Aug. 4, 1987

[54] POWDER ACTUATED FASTENING SYSTEM AND FASTENER ASSEMBLY FOR USE THEREWITH

[76] Inventor: Fernando Masas, 30 Stagg St., Stratford, Conn. 06497

[21] Appl. No.: 785,274

[22] Filed: Oct. 7, 1985

[51] Int. Cl.[4] ..... B25C 1/08; B25C 1/14; B25C 1/18

[52] U.S. Cl. ..... 227/10; 227/8; 227/9

[58] Field of Search ..... 227/9, 10, 11, 147, 227/8; 248/216.1, 547; 411/439, 440, 441

[56] References Cited

U.S. PATENT DOCUMENTS

| | | | |
|---|---|---|---|
| 2,258,861 | 10/1941 | Park et al. | 227/147 |
| 2,588,738 | 3/1952 | Lundgren | 227/147 |
| 2,806,218 | 9/1957 | Henning et al. | 227/11 |
| 2,863,149 | 12/1958 | Kopf et al. | 227/11 |
| 3,040,325 | 6/1962 | Reymond | 227/11 |
| 3,320,845 | 5/1967 | Eschweiler | 411/441 |
| 3,998,372 | 12/1976 | Leonardo et al. | 227/9 |

FOREIGN PATENT DOCUMENTS

| | | | |
|---|---|---|---|
| 0484427 | 8/1976 | Australia | 411/441 |
| 0844222 | 8/1966 | United Kingdom | 227/11 |

*Primary Examiner*—Howard N. Goldberg
*Assistant Examiner*—Taylor J. Ross
*Attorney, Agent, or Firm*—Arthur T. Fattibene

[57] ABSTRACT

A powder actuated fastening system that includes a powder actuated gun having detactably connected to the end thereof one of several differently constructed holders adapted to receive and support therein a fastener assembly which is forceably driven by the gun into a supporting structure. The fastener assembly in accordance with this invention comprises a member having a stud extended therethrough whereby the stud is rigidly secured to the member by friction. The member of such assembly may be formed of different configuration depending upon the ultimate function of the fastener assembly, and which system includes a complementary fastener holder detactably connected to the end of the gun to accommodate particular fastener assembly.

8 Claims, 21 Drawing Figures

20
21
21A
22
23
24
24A
24B
25
25A
26
40
42
50
2
2

24
24A
24B
49
45D
26
45A
45B
49
42
40A
40B
40B 51
52
52A
52B
53
53A
54
26
50

27
42

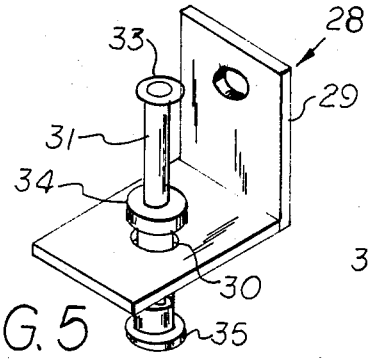
FIG. 5
PRIOR ART
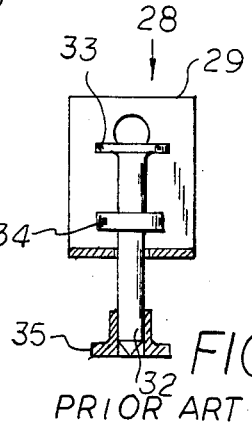
FIG. 6
PRIOR ART
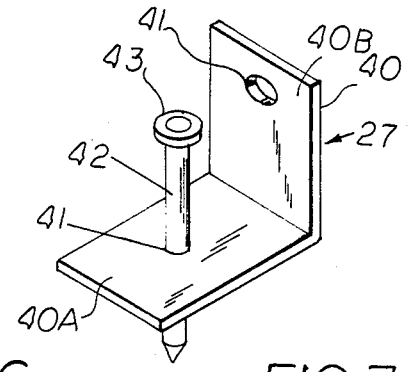
FIG. 7
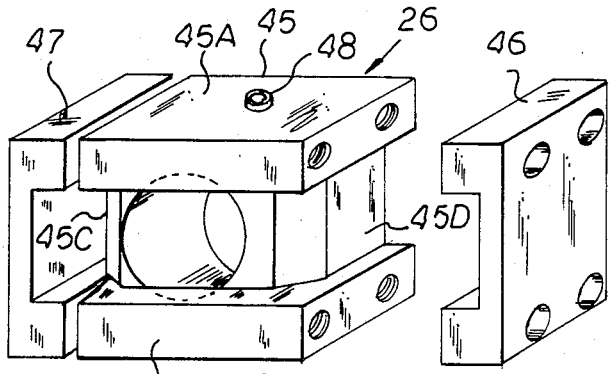
FIG. 12
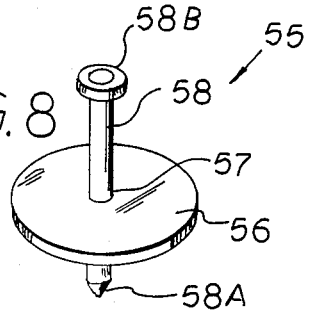
FIG. 8
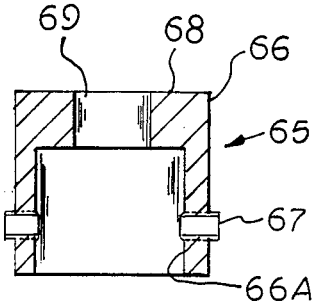
FIG. 15
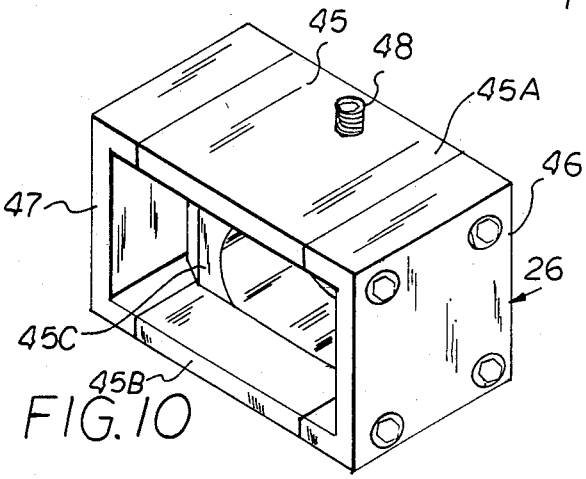
FIG. 10
FIG. 14
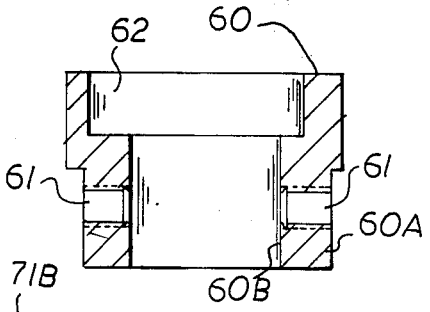
FIG. 11
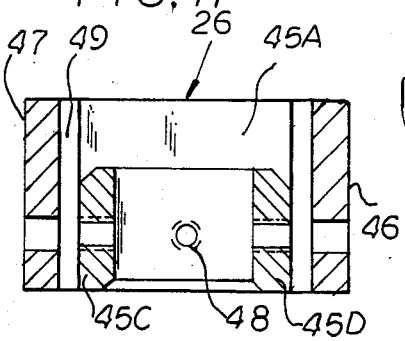
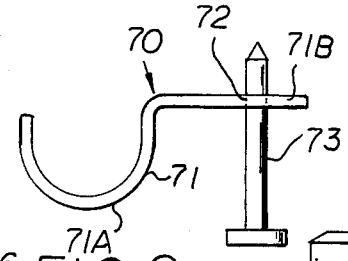
FIG. 9
FIG. 13
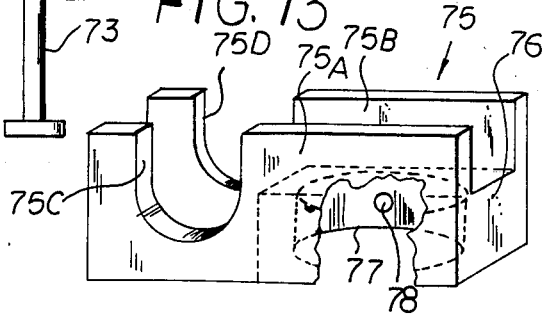

POWDER ACTUATED FASTENING SYSTEM AND FASTENER ASSEMBLY FOR USE THEREWITH

BACKGROUND OF THE INVENTION

In the construction industries there is occassioned the need to apply numerous fasteners and/or fastener assembly to a support wall for various reasons, e.g. to secure walls to a supporting sub-structure, to secure various types of holders and clamps to walls and ceilings for supporting other devises as e.g. pipes, wires, conducts and the like. Frequently, the walls to which such fasteners are required to be driven are formed of stone, brick, masonary or other rigid materials thereby making it exceedingly difficult to drive a stud or fastener thereinto. To expedite the driving of studs or fasteners into such walls there have been developed various powder actuated guns to forceably drive such fasteners into a supporting structure. Such guns are constructed so that it is essential that the muzzle end of the gun must be forceably pressed against the supporting surface to effect a slight retraction before the trigger setting off the powder charge can be actuated. This feature in such fastener guns is essential for safety reasons.

Heretofore, the known fastener assembly for use with such powder actuated guns comprised a member defining a suitably shaped bracket, support or mount having an aperture formed therein for receiving a stud by which such member is secured to a supporting surface. Such aperture was formed to loosely receive this stud. To secure such studs to its bracket member and to effect the alignment of the stud within the muzzle of a powder actuated fastener gun, there was provided a collar disposed on the studs intermediate the length of the stud so as to be disposed on one side of the mount or bracket member and flanged eyelet fitted to the pointed end of the stud. The arrangement of such prior known fastener assembly was such that the headed end of the stud and the collar spaced therefrom functioned to maintain the alignment of the fastener assembly in the muzzle of the powder actuated gun, the collar and eyelet also coacted to retain the stud to its associated member, bracket, clamp, etc.

When said prior constructed fastener was placed in the muzzle end of a powder actuated fastener gun, it was essential that the pointed end of the stud be forceably pressed against the wall in a perpendicularly manner to render the gun operational. Such perpendicularly applied force was frequently rendered uncertain when the bearing point of such force comprised the pointed end of the stud only. Any slight deviation of the applied force in a direction other than perpendicular would result in a misfire. Also as described, the prior known fastener assembly requires the need of a collar and eyelet in addition to the stud. Such collar and eyelet necessitated an assembly operation which added to the time, effort and cost of manufacturing said fastener assemblies.

OBJECTS

An object of this invention is to provide an improved powder actuated fastener system in which the fastener assembly can be readily fabricated and assembled with a minimum of time, effort, and material to result in a substantial economical saving.

Another object is to provide for a holder which is detactably connected to the muzzle end of a powder actuated fastener gun for accomodating a particular fastener assembly.

Another object is to provide a powder actuated fastening system whereby the direct application of a perpendicularly applied force is assured so as to prohibit and/or avoid any probability of a mis-fire.

SUMMARY OF THE INVENTION

The foregoing objects and other features and advantages are attained in a powder actuated fastening system which comprises a power or powder actuated fastening gun having detactably connected to the muzzle end thereof a holder or fixture adapted to accommodate an improved fastener assembly. In accordance with this invention the fastener gun may be provided with either a long or short fastener guide. The improved fastener assembly comprises a member in the form of a bracket, clamp, washer or the like which is formed with an aperture for frictionally securing the shank of a stud or nail therein. One end of the stud is provided with a point and the other end has connected thereto a head having a diameter adapted to be received within the end of the fastener guide which defines the muzzle end of the fastener gun. The arrangement is such that the holder attached to the muzzle end of the fastener gun maintains the stud or nail normal to the wall during a firing operation. In the form of the invention in which a short fastener guide is installed in a fastener gun, the holder defines a bearing area which insures that the fastener gun is disposed perpendicular to a support structure so as to insure against any misfire.

FEATURES

A feature of this invention resides in the provision of a specifically constructed holder or fixture being attached to the muzzle end of a fastener gun for positioning thereto the improved simplified fastener assembly.

Another feature resides in the provision of a fastener guide for use in a powder actuated fastening gun having a short barrel portion whereby the holder or fixtures attached to the muzzle end of the gun defines the bearing area resisting the applied perpendicular force necessary to effect the actuation of the gun.

Another feature of this invention resides in the provision of a simplified fastener assembly which comprises a member which may be formed in the shape of a bracket, clamp, washer or the like having an aperture for frictionally retaining the shank of a stud or nail secured thereto.

Another feature resides in the provision of an improved fastening assembly which consists only of the member and its associated stud or nail.

Another feature resides in the provision of a holder or fixture detactably connected to the muzzle end of a fastener gun for accommodating a particular fastener assembly in position against a support surface to which the fastener is to be secured.

Other features and advantages will become more readily apparent when considered in view of the drawings and specification in which:

FIG. 5 is a perspective view of a prior art fastener construction.

FIG. 6 is a front view of the prior art fastener construction of FIG. 5.

FIG. 7 is a perspective view of a fastener assembly embodying this invention.

FIG. 8 is a modified fastener assembly embodying this invention.

FIG. 9 is another modified fastener assembly embodying this invention.

FIG. 10 is a perspective view of a holder or fixture for accommodating the fastener assembly of FIG. 7 to the fastener gun.

FIG. 11 is a sectional view taken along line 11—11 on FIG. 10.

FIG. 12 is an exploded projective view of the holder of FIGS. 10 & 11.

FIG. 13 is a perspective view of a holder for accomodating the fastener assembly of FIG. 9 on the end of a fastener gun.

FIG. 14 is a sectional view of a holder adapted to accommodate the fastener assembly of FIG. 8 on the end of a fastener gun.

FIG. 15 is a modified holder for accommodating this fastener assembly of FIG. 8.

DETAILED DESCRIPTION

Figures 1, 1A, 2, 3, 3A, 4:
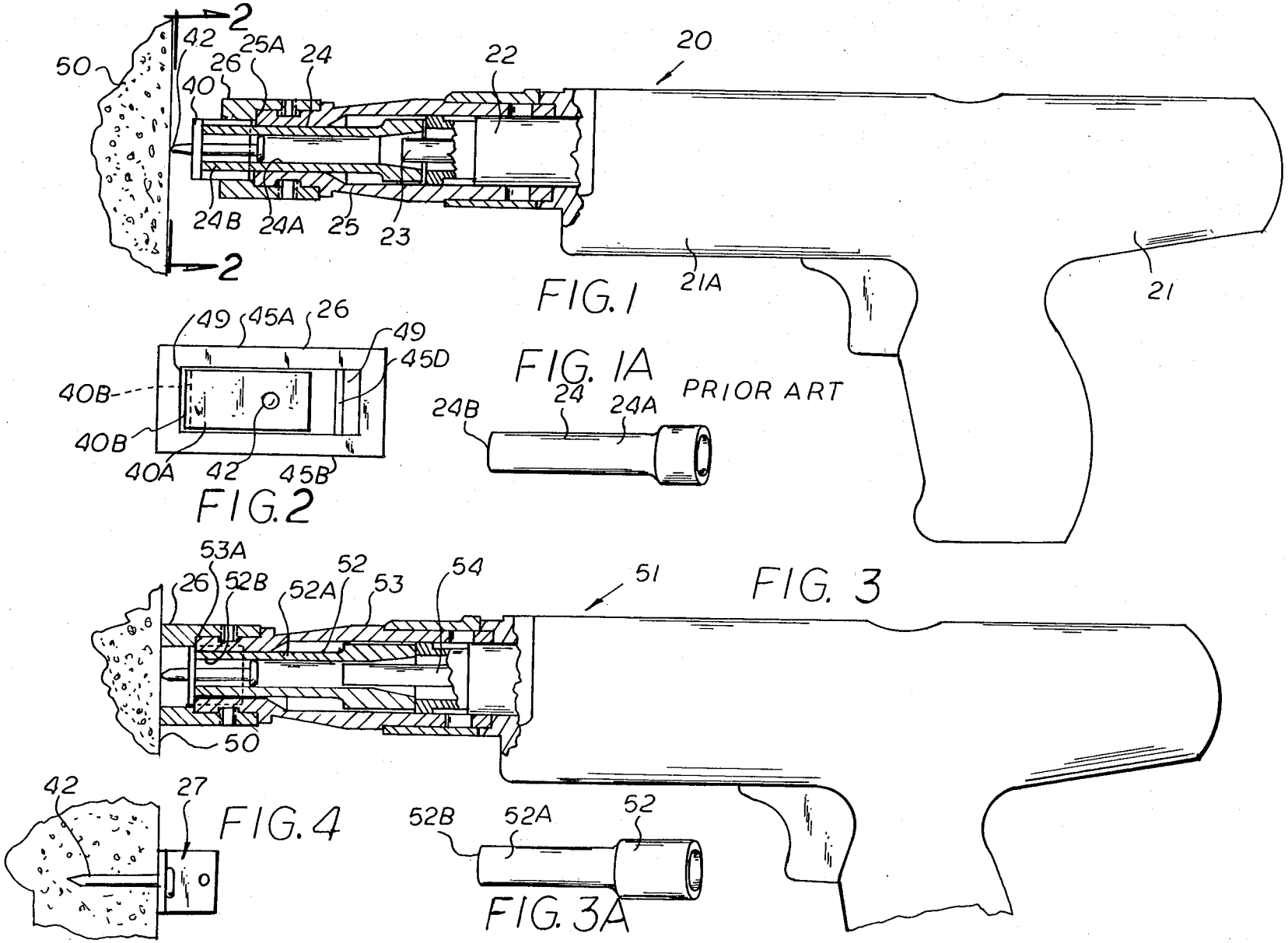
FIG. 1A PRIOR ART
FIG. 1 is a slide elevation view of a powder actuated fastening gun or tool embodying the invention.
FIG. 1A is a detailed showing of a conventional long barrel guide used in the fastener gun of FIG. 1.
FIG. 2 is a front end view taken along line 2—2 on FIG. 1.
FIG. 3 is a modified form of the invention wherein the fastening gun is provided with a fastener guide formed with a short barrel portion.
FIG. 3A is a modified short barrel fastener guide used in the fastener gun of FIG. 3.
FIG. 4 is a detailed view illustrating the improved fastener assembly of this invention secured to a supporting surface.

Referring to the drawings, and in particular to FIG. 1, there is disclosed a powder actuated fastening system 20 in accordance with the present invention. Essentially this sytem 20 comprises a powder actuated fastening gun or tool 21 which are well known in the art. One such fastening tool or gun 21 is manufactured by Hilti Fastening Systems of Tulsa, Oklahoma. Other manufacturers make similar type tools. Such fastening guns employ a powder charge for projecting a fastener into a supporting wall or structure as shown in FIG. 4.

FIG. 1 illustrates a fastener gun or tool 21, e.g. a Hilti DX 350 model which includes a gun body 21A containing a piston guide 22 in which the firing piston 23 is reciprocally mounted. Disposed in coincidence with this piston guide 22 and in alignment therewith is a fastener guide 24. The fastener guide 24 is maintained in position by a base plate or nose sleeve 25 which is slidably connected relative to its piston guide 22. FIG. 1A illustrates a detail of the fastener guide 24. As shown in FIGS. 1 and 1A this fastener guide 24 is provided with a relatively long barrel portion 24. In the assembled position as shown in FIG. 1, the front end 24B of the fastener guide 24 normally projects beyond the front end 25A of the base plate or nose sleeve 25.

In accordance with this invention the system includes a holder or fixture 26 detachable connected to the front or muzzle end of the fastener gun or tool 21 for positioning thereto an improved fastener assembly 27 as will be hereinafter described.

FIGS. 5 & 6 illustrate a fastener 28 of the prior art construction which are conventionally used with a Hilti type powder actuated gun. Generally such prior art fastener assemblies include a bracket member 29, e.g. an angle bracket having an aperture 30 formed in one of the leg members as shown. Extended through the aperture 30 is a stud or shank 31 having a point 32 on one end and a flat head 33 on the other end. As shown the diameter of the aperture 30 was larger than that of the stud, so that the stud was loosely retained in the aperture. To prohibit separation of the stud 31 from its bracket member 29, and to facilitate the positioning of the stud 31 within the bore of the fastener guide of the tool a collar 34 generally formed of a plastic material was frictionally secured to the stud 31 to one side of the bracket member 29 at a point intermediate the length of the stud 31. Surrounding the pointed end 32 of the stud 31 disposed to the other side of the bracket member was a flanged eyelet 35 frictionally secured thereto. Both the head 33 and the collar 34 were sized to be received within the bore of the fastener guide so as to maintain the axial alignment of the stud 31, which is essential and necessary to maintain the stud perpendicular to the wall into which it is to be fired. This is because the gun must be disposed perpendicular to the support wall to effect the firing thereof. Therefore, unless the stud 31 of the fastener assembly is perpendicular to the wall to which it is to be fastened, the gun by the inherent construction thereof cannot fire. Accordingly such prior known fastener assembly comprises at least four component parts that are required to be pre-assembled to define the fastener assembly.

In accordance with this invention, the improved fastener assembly, as shown in FIGS. 7, 8 and 9 comprise simply of a bracket type member and the stud, thereby eliminating the need of a collar 34 and eyelet 35 of the prior art fastener construction 28, herein described.

As best seen in FIG. 7, the improved fastener assembly 27 comprises a member 40 defined as an angle in which one or both leg portions 40A and 40B may be provided with an aperture 41. In accordance with this invention the aperture 41 of member 40 is sized so as to frictionally retain the shank of a stud 42 forceably inserted through the aperture 41. The stud 42 is provided with a head portion 43 to prohibit the stud from passing through the aperture 41 when shot.

To locate the fastener assembly of FIG. 7 to the end of the gun, a holder or fixture 26 is provided. FIGS. 10, 11 & 12 illustrate the holder or fixture 26 for accommodating the fastener assembly of FIG. 7. As shown, the holder or fixture 26 of FIGS. 10 to 12 comprises body 45 having opposed side wall portion 45A, 45B interconnected by partitions 45C, 45D, the inner surfaces being shaped to receive the front end of the base plate or nose sleeve 25. Connected to the opposed end of the side wall portions 45A and 45B are end walls 46 and 47 which when assembled are spaced slightly from the partition 45C and 45D adjacent thereto. As best seen in FIG. 1, the partition 45C and and 45D defining the bore for receiving the front end of the base plate are recessed or spaced inwardly from the front plane of the fixture 26. Suitable set screws 48 are provided for detachable connecting the fixture 26 to the front end of the gun as seen in FIG. 1.

With the fixture or holder 26 of FIG. 10 to 12 secured to the front of the gun, the fastener assembly 27 of FIG. 7 is disposed so that the leg portion 40A containing the stud 42 extends over the front end of the fastener guide with the stud 42 centered in the fastener guide 24. (See FIG. 1) This other leg 40B of the fastener assembly 27 is received in the slot 49 defined between the adjacent partition and end wall, as best seen in FIG. 2. With the fastener 27 and its holder 26 assembled to the gun as shown in FIG. 1, the point of the stud is pressed against the support, wall or structure 50 and by the application of a perpendicularly applied force, the fastener assembly 26 and fastener guide 25 are retracted in unison so that the gun can be fired to project the stud 42 into the wall as shown in FIG. 4.

FIGS. 3 and 3A illustrates a modified embodiment. In this form of the invention, the powder actuated fastener system 51 is identical to that of FIG. 1 except that a short barrel fastener guide 52 as shown in FIG. 3A is substituted for the long barrel guide 24 of FIGS. 1 and 1A. By using the guide 52A of FIG. 3A in the gun assembly of FIG. 3 the front end 52B of the fastener guide is disposed co-planner with the front end 53A of the base plate or sleeve 53 of gun 51. As noted in FIG. 3, the front area of the fixture 26 is brought to bear against the wall when the perpendicular force is applied to effect the firing of the gun. In this form of the invention this perpendicular application of the force is rendered more positive since the front end of the fixture 26 insures the perpendicular positioning of the fastener gun 51 relative to the supporting structure 50 receiving the fastener assembly 27.

FIG. 8 illustrates a modified fastener assembly 55. In this form the fastener assembly 55 comprises a flat plate, e.g. a disk or washer 56 as illustrated with a central aperture 57 sized to frictionally retain a stud therein. The stud 58 is similar to that previously described with respect to FIG. 7, in that it is pointed at one end 58A and headed at 58B.

The fixture or holder 60 for accommodating the fastener 55 of FIG. 8 to the front of the gun, e.g. in FIG. 3, is illustrated in FIG. 14. As shown, the holder 60 of FIG. 14 comprises a mounting portion 60A containing a bore 60B for receiving the front end of the base plate or nose 53 of the gun 51. Set screws 61 or the like detachably secure the fixture or holder 60 to the base plate 53 of the gun 51. Connected forwardly of the mounting portion 60A is a recessed seat 62 for receiving the plate member 56 of the fastener assembly 55. The arrangement is such that with the plate member 56 seated in the seat 62 of holder 60, the head end 58B of the stud 58 is received in the fastener guide 52 of gun 51 whereby the stud can be driven by the piston 54 when the gun 51 is fired. In this form of the invention the front end of the holder 60 is pressed against the wall 50 until the holder 60, fastener assembly 55 and fastener guide is retacted a distance sufficient to actuate the gun.

FIG. 15 illustrates a modified holder 65 for supporting the fastener assembly 55 of FIG. 8 on the end of the gun. In this form of the invention the holder 65 comprises a part 66 having a bore 66A at one end by which it is fitted to the end of the base plate or nose sleeve of a gun secured thereto, e.g. by set screws 67 or the like. The front surface 68 is provided with an aperture 69 sufficient to accommodate the head 58B of the stud 58. Thus, with the holder 65 fixed to the base plate or nose sleeve of the gun, the head end 58B of the stud is inserted into the opening so that the flat member 56 bears on the front end 68 of the holder. In this form of the invention the point 58A of the stud 58 defines the bearing area when perpendicular force is applied to fire the gun.

FIG. 9 illustrates a modified bracket assembly 70. In this form of the invention the member 71 comprises a clamp having a U-shaped or arcuate portion 71A adaped to accommodate a pipe, conduct or the like having a laterally extended flange portion 71B. The flanged portion 71B is provided with an aperture 72 sized to frictionally retain the shank of a stud 73 therein similar to that hereinafter described.

The holder 75 for accommodating or supporting the fastener assembly 70 of FIG. 9 to the front end of a fastener gun is illustrated in FIG. 13. As shown the holder 75 comprises a pair of spaces apart side walls 75A, 75B each having an aligned cut-out portion 75C, 75D for receiving therebetween the U-shaped portion 71A of the fastener 70. Disposed to one side and between the oppossed side walls 75A and 75B there is provided a means 76 defining a base 77 for receiving the front end of the base plate or nose sleeve, e.g. 53 of the fastener gun 51. Suitable set screws 78 are provided for securing the holder 75 to the gun. With the holder 75 secured to the front end of the gun in a manner similar to that shown in FIG. 3, the fastener assembly 70 of FIG. 9 is disposed between the side walls, 75A and 75B of the holder 75 so that the lateral flange 71B extends over the mounting portion or base 77 so that the headed end of the stud is disposed in the fastener guide. The arcuate or U-shaped portion 71A of member 71 is disposed in alignment with the cut-out portions 75C and 75D of the side wall 75A and 75B. Thus, the fastener assembly 70 of FIG. 9 is disposed within its holder 75 whereby it can be readily applied to the supporting wall when the proper applied force is supported on the gun.

Figure 16:
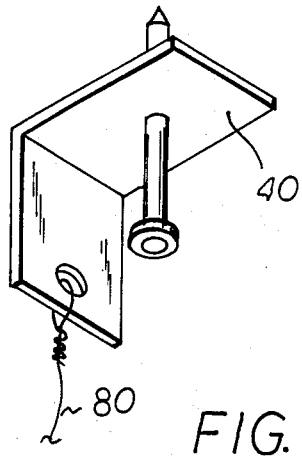
FIG. 16 is another version of a fastener assembly embodying the invention.
Figure 17:
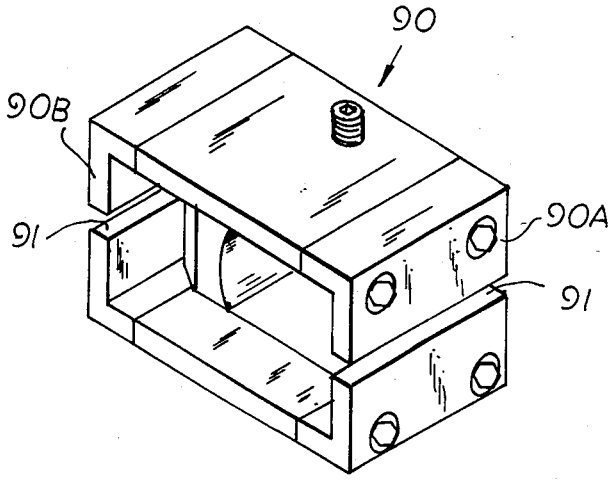
FIG. 17 is a perspective detail view of a modified holder of the type shown in FIG. 12.

FIG. 16 illustrates a fastener assembly like that of FIG. 7 with the exception that a wire hanger 80 is connected to the bracket 40. Such wire hangers 80 have utility in supporting a suspended ceiling and/or wherein the wire hanger 80 may be used to support a pipe or the like when the bracket 40 is shot into a support structure. In order to accommodate a fastener of the type disclosed in FIG. 16, a modified holder 90, as shown in FIG. 17, is required to be attached to the muzzle end of a powder actuated gun, as herein described.

The holder 90 is identical to that described with respect to FIGS. 10 to 12, with the exception that one or both of the end walls 90A, 90B is provided with a slot 91 for accommodating the wire hanger 80 when the fastener of FIG. 16 is to be applied. In operation, the holder 90 is attached to the muzzle end of a powder actuated gun in the same manner as described with respect to the holder 26 of FIGS. 10 to 12. Because of the end slots 91, a fastener having a wire 80 connected thereto can be readily disposed in the holder 90.

Figure 18:
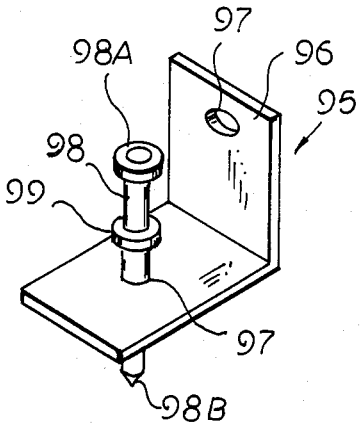
FIG. 18 is a modified fastener assembly.
Figure 19:
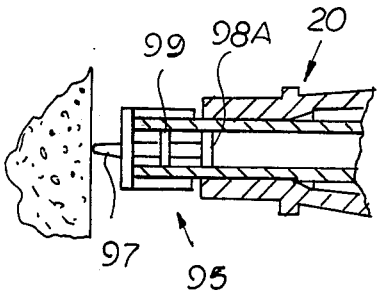
FIG. 19 is a sectional view illustrating the fastener assembly of FIG. 18 loaded in a powder actuated fastening gun or tool.

FIGS. 18 and 19 illustrate a further fastener modification. In this form of the invention, the fastener 95 comprises a bracket 96, which is illustrated as an angle; but which may assume any bracket configuration. Disposed in a leg portion is an opening or hole 97 adapted to be received in frictional securement a stud or shank 98. As previously described, the shank 98 is provided with a head 98A at one end and a point 98B at its other end. Disposed intermediate the end of the shank or stud 98 is a collar 99. The collar 99 is frictionally secured to the stud and disposed on the same side of the bracket 96 as the head portion 98A of the stud 98.

The fastener construction 95 of FIG. 18 is such that it can be directly loaded into the muzzle end of a gun 20, without resorting to a holder. As best seen in FIG. 19, the fastener 95 can be directly applied to the gun by inserting the head end 98A and the collar 99 of the stud 97 directly into the muzzle end of the gun 20. Thus, the co-action between the spaced head portion 98A and the collar 99 function to securely retain the fastener 95 to the muzzle end of the gun.

From the foregoing, it will be apparent that various modifications and variations may be had without departing from the spirit and scope of the invention.

What is claimed is:

1. A power actuated fastening system including a power actuated gun having a nose sleeve and a fastener guide having a bore defining the muzzle end of said gun slidably mounted relative to said nose sleeve whereby said fastener guide must be forceably retracted into said nose sleeve before said gun can be fired. the improvement comprising a holder having a bore by which said holder is fitted to the end of said nose sleeve, said holder having a front end circumscribing said fastener guide and adapted to be urged in normal bearing relationship to a wall means for securing said holder to said nose sleeve, a fastener means positioned in said holder, said fastener means including a member having a plannar surface adapted to be retained in said holder and engaging said fastener guide, said member having an aperture extended through the thickness of said plannar surface, said aperture being disposed in alignment with said bore of said fastener guide, a stud extended through said aperture of said plannar surface, said stud having a shank portion frictionally secured to said aperture, and said stud having a head portion sized to be snugly received in the bore of said fastener guide whereby said member and said head portion of said stud maintains said stud normal to a wall during a firing operation of said gun as said front end of said holder insures said normal position of said stud.

2. A powder actuated fastener system as defined in claim 1 wherein said fastener guide includes a long barrel portion normally extending beyond the front plane of said holder whereby said stud projects beyond the bore of said holder in the inoperative portion of said gun.

3. A powder actuated fastener system as defined in claim 1 wherein said fastener guide includes a short barrel so as to have its end portion coincide with the end said base portion in the normal inoperative portion of said gun.

4. A power actuated fastener system as defined in claim 3 wherein said holder includes a recessed plane for receiving the bore portion of said gun, and said fastener means being recessed in said holder so that the end of said stud is generally disposed in the front plane of said holder in the normal inoperative position of said gun prior to firing.

5. A powder actuated fastener system as defined in claim 1 wherein said member comprises an angled member having normally disposed leg portion, at least one of said portions having said aperture, and said holder having a slot formed therein for receiving one of said leg portions when said member is retained in said holder.

6. A powder actuated fastener system as defined in claim 5 wherein said holder comprises a rectangular disposed wall portion, means defining a bore disposed between a pair of opposed wall portions, said bore defining means being spaced from the other pair of opposed wall portion to define opposed slots, and said bore defining means having a width less than the width of said wall portions.

7. A holder adapted to be secured to the end of a powder actuated fastener gun comprising ' a fixture having a pair of opposed wall portions, a pair of interconnecting spaced apart partitions disposed between said opposed wall portions, said partitions having their inner surface shaped to conform to the shape of the end of a fastener gun, and a pair of end walls connected to the ends of said opposed wall portion, said end walls being spaced from said partition adjacent thereto.

8. A holder as defined in claim 7, wherein at least one of said end walls is provided with a slot formed therein.

* * * * *